United States Patent [19]

Martischius et al.

[11] Patent Number: 5,009,670

[45] Date of Patent: Apr. 23, 1991

[54] FUELS FOR GASOLINE ENGINES

[75] Inventors: Franz-Dieter Martischius, Neustadt; Hans-Henning Vogel, Frankenthal; Norbert Greif, Bobenheim; Knut Oppenlaender, Ludwigshafen; Walter Denzinger, Speyer; Heinrich Hartmann, Limburgerhof, all of Fed. Rep. of Germany

[73] Assignee: BASF Aktiengesellschaft, Fed. Rep. of Germany

[21] Appl. No.: 352,418

[22] Filed: May 16, 1989

[30] Foreign Application Priority Data

May 19, 1988 [DE] Fed. Rep. of Germany ..... 3817000

[51] Int. Cl.[5] ..... C10L 1/14

[52] U.S. Cl. ..... 44/385; 44/387; 44/408

[58] Field of Search ..... 44/62, 70, 71, 72; 525/193, 309, 333.7, 379, 384, 320

[56] References Cited

U.S. PATENT DOCUMENTS

| | | | |
|---|---|---|---|
| 2,851,345 | 9/1958 | Marsh et al. | 44/62 |
| 3,100,695 | 8/1963 | Slysh et al. | 44/62 |
| 3,256,073 | 6/1966 | Hess | 44/62 |
| 3,342,734 | 9/1967 | Bauer | 44/62 |
| 3,397,145 | 8/1968 | Cyba | 44/62 |
| 3,658,493 | 4/1972 | Hollyday, Jr. | 44/62 |
| 3,807,976 | 4/1974 | Polss | 44/62 |
| 4,375,973 | 3/1983 | Rossi et al. | 44/62 |
| 4,489,194 | 12/1984 | Hayashi | 44/62 |
| 4,620,855 | 11/1986 | Higgins | 44/62 |
| 4,765,800 | 8/1988 | Vanes et al. | 44/62 |

*Primary Examiner*—Margaret B. Medley
*Attorney, Agent, or Firm*—Keil & Weinkauf

[57] ABSTRACT

Fuels for gasoline engines contain small amounts of copolymers of alkyl (meth)-acrylates where the alkyl radical is of 8 to 40 carbon atoms and/or vinyl esters of carboxylic acids of 8 to 40 carbon atoms and monoethylenically unsaturated mono- and/or dicarboxylic acids of 3 to 12 carbon atoms and/or monoethylenically unsaturated compounds having sulfo and/or phosphonic acid groups, having a total molecular weight of from 500 to 20,000 g per mole, some or all of the carboxyl, sulfo and phosphonic acid groups of the copolymers having been reacted with an alkali or alkaline earth with formation of the alkali metla salts or alkaline earth metal salts and the remainder of the acid groups having been reacted with ammonia and/or amines of not more than 50 carbon atoms to give the corresponding amide groups and/or ammonium salts.

3 Claims, No Drawings

FUELS FOR GASOLINE ENGINES

The present invention relates to fuels for gasoline engines, containing copolymers of alkyl (meth)acrylates where the alkyl radical is of 8 to 40 carbon atoms and/or vinyl esters of carboxylic acids of 8 to 40 carbon atoms and monoethylenically unsaturated mono-and/or dicarboxylic acids of 3 to 12 carbon atoms and/or monoethylenically unsaturated compounds having sulfo and/or phosphonic acid groups, some or all of the carboxyl, sulfo and phosphonic acid groups (referred to below as acid groups) of the copolymers being in the form of the alkali metal or alkaline earth metal salts and any remaining acid groups being in the form of amide groups and/or ammonium salt groups.

German Laid-Open Application DOS 3,620,651 discloses that small amounts of alkali metal salts or alkaline earth metal salts of certain derivatives of succinic acid can be added to the fuels to prevent or reduce wear at the outlet valves or valve seats of gasoline engines. However, the compounds have the disadvantage that they do not have a corrosion-reducing effect in gasoline engines.

It is an object of the present invention to provide substances which, in addition to preventing or reducing wear at the valves of gasoline engines, also reduce the corrosion in the said engines.

We have found, surprisingly, that this object is achieved by fuels for gasoline engines, containing small amounts of copolymers of alkyl (meth)acrylates where the alkyl radical is of 8 to 40 carbon atoms and/or vinyl esters of carboxylic acids of 8 to 40 carbon atoms and monoethylenically unsaturated mono- and/or dicarboxylic acids of 3 to 12 carbon atoms and/or monoethylenically unsaturated compounds having sulfo and/or phosphonic acid groups, having a total molecular weight of from 500 to 20,000 g per mole, some or all of the carboxyl, sulfo and phosphonic acid groups of the copolymers having been reacted with an alkali or alkaline earth with formation of the alkali metal salts or alkaline earth metal salts and the remainder of the acid groups having been reacted with ammonia and/or amines of not more than 50 carbon atoms to give the corresponding amide groups and/or ammonium salts.

The novel fuel additives have the advantage that they do not disadvantageously affect the action of conventional gasoline additives in the gasoline engines and at the same time prevent or greatly reduce the occurrence of wear in the valves and, surprisingly, furthermore substantially reduce or even prevent the occurrence of corrosion in the gasoline engines.

The novel fuel additives are advantageously prepared in two process stages. The first process stage is the preparation of the copolymers of alkyl (meth)acrylates where the alkyl radical is of 8 to 40 carbon atoms and/or vinyl esters of carboxylic acids of 8 to 40 carbon atoms and monoethylenically unsaturated mono- and/or dicarboxylic acids of 3 to 12 carbon atoms and/or monoethylenically unsaturated compounds having sulfo and/or phosphonic acid groups. In the second process stage, some or all of the acid groups of the resulting copolymers are reacted with an alkali or alkaline earth with formation of the alkali metal salts or alkaline earth metal salts. It is advantageous to convert all of the acid groups of the copolymers into the alkali metal salts or alkaline earth metal salts when the resulting alkali metal salts or alkaline earth metal salts themselves are sufficiently soluble in the fuels to which they are to be added. If the solubility is insufficient, it is advantageous to react only some of the acid groups of the copolymers with an alkali or alkaline earth with formation of the alkali metal salts or alkaline earth metal salts and to react the remainder of the acid groups with ammonia and/or amines to give the corresponding amide groups and/or ammonium salts, in order to obtain adequate solubility. To achieve the required solubility of the fuel additives, it is furthermore advantageous if, in the preparation of the copolymers from alkyl (meth)acrylates and/or vinyl esters having a small number of carbon atoms in the alkyl/carboxylic acid group, in the second process stage relatively long-chain amines are used in the further reaction with amines and/or, if necessary, the proportion of acid groups to be reacted with the amines is increased. Correspondingly, when alkyl (meth)acrylates and/or vinyl esters having a relatively large number of carbon atoms in the alkyl/carboxylic acid group are used for the preparation of the copolymers, in the second process stage amines having shorter alkyl chains can be used and/or the proportion of acid groups to be reacted with the amines can be reduced.

The proportion of building blocks having an acid function in the copolymer should be sufficiently high for the alkali metal salts and alkaline earth metal salts of the copolymers, if necessary after further reaction with ammonia and/or amines to form amides and ammonium salts, to be soluble in fuels for gasoline engines. It is advantageous to incorporate a larger amount of large molecules containing few acid groups such as methacrylic acid than molecules containing many acid groups such as maleic acid or maleic anhydride. Advantageously, not more than 60, preferably not more than 30, % by weight of monomers containing acid groups are incorporated into the copolymer as copolymerized units.

Suitable alkyl (meth)acrylates are all esters of acrylic acid and methacrylic acid with straight-chain alcohols of 8 to 40 carbon atoms, eg. 2-ethylhexyl acrylate, 2-ethylhexyl methacrylate, n-decyl acrylate, n-decyl methacrylate, dodecyl acrylate, dodecyl methacrylate, isotridecyl acrylate, isotridecyl methacrylate, tetradecyl acrylate, tetradecyl methacrylate, $C_{16}/C_{18}$-tallow fatty alcohol methacrylate, octadecyl acrylate, octadecyl methacrylate, n-eicosyl acrylate, n-eicosyl methacrylate, n-docosyl acrylate, n-docosyl methacrylate, tetracosyl acrylate, hexacosyl acrylate, hexacosyl methacrylate, octacosyl acrylate, octacosyl methacrylate and mixtures of these, for example $C_{18}$-$C_{22}$-alkyl acrylate. $C_{16}$-$C_{28}$-alkyl (meth)acrylates are preferred. Suitable vinyl esters are all those based on branched and straight-chain monocarboxylic acids of 8 to 40 carbon atoms. For example, vinyl 2-ethylhexanoate, vinyl laurate, vinyl tallow fatty esters, vinyl myristate, vinyl palmitate, vinyl stearate, vinyl oleate and mixtures of these are suitable.

Suitable monoethylenically unsaturated mono- and/or dicarboxylic acids are those which have 3 to 12 carbon atoms in the molecule, eg. acrylic acid, methacrylic acid, crotonic acid, vinyllactic acid, allylacetic acid, propylideneacetic acid, ethylacrylic acid, dimethylacrylic acid and the dicarboxylic acids maleic acid, fumaric acid, itaconic acid, glutaconic acid, methylenemalonic acid, citraconic acid and tetrahydrophthalic acid. As a rule, it is advantageous to use the dicarboxylic acids in the copolymerization in the form of the anhydrides, where these are available, for example maleic anhydride, itaconic anhydride, citraconic anhydride, methylenemalonic anhydride and tetrahydrophthalic anhydride, since the anhydrides generally undergo copolymerization more readily with the (meth)acrylates and vinyl esters. The anhydride groups can then generally be reacted directly with the amines or with the hydroxides of the alkali metals or alkaline earth metals, without prior conversion of the anhydride group into the acid with water. For reasons relating to solubility, it is sometimes advantageous to use the monoesters of the stated dicarboxylic acids with alcohols of 2 to 40 carbon atoms, for example monoethyl maleate, monobutyl maleate, monododecyl maleate, monooctadecyl maleate, monotetracosyl maleate, monooctadecyl fumarate, monooctadecyl itaconate and mixtures of these. Acrylic acid, methacrylic acid, maleic acid (anhydride) and itaconic acid (anhydride) are particularly preferred. Examples of monoethylenically unsaturated compounds having sulfo groups are vinylsulfonic acid, allylsulfonic acid, methallylsulfonic acid, 3-sulfopropyl acrylate, 3-sulfopropylmethacrylate, 2-acrylamido-2-methylpropanesulfonic acid, 2-methacrylamido-2-methylpropanesulfonic acid, p-styrenesulfonic acid and bis-(3-sulfopropyl) itaconate.

Examples of suitable monoethylenically unsaturated compounds containing phosphonic acid groups are vinylphosphonic acid, divinylphosphonic acid, allylphosphonic acid, methallylphosphonic acid, methacrylamidomethanephosphonic acid, 2-arylamido-2-methylpropanephosphonic acid, 3-phosphonopropyl acrylate and 3-phosphonopropyl methacrylate. Suitable monoethylenically unsaturated compounds containing sulfo and phosphonic acid groups are in principle all those which can be copolymerized with (meth)acrylate and vinyl esters and, in the form of the alkali metal salts and alkaline earth metal salts, if necessary after the addition of amines, are soluble in fuels for gasoline engines.

Instead of the subsequent reaction of the acid groups, in particular the carboxyl groups, with amines to give the corresponding amides and, if appropriate, ammonium salts, it may sometimes be advantageous to prepare the corresponding N-alkylamides of the monoethylenically unsaturated mono- and dicarboxylic acids in the form of the monomers and then to copolymerize these directly in the polymerization. However, this is generally technically more complicated since the amines can undergo addition at the double bond of the monomeric mono- and dicarboxylic acids and then prevent copolymerization. Such monoethylenically unsaturated N-alkylamides are, for example, N-isotridecylacrylamide, N-diisotridecylacrylamide, N-stearylacrylamide, N-stearylmethacrylamide, maleic acid monoisotridecylamide, maleic acid diisotridecylamide, maleic acid monostearylamide and maleic acid distearylamide.

The copolymers have molecular weights of from 500 to 20,000, preferably from 800 to 10,000, g/mole.

The preparation is carried out by known conventional batchwise or continuous polymerization methods, such as mass, suspension, precipitation or solution polymerization, and initiation with conventional free radical initiators, for example acetylcyclohexanesulfonyl peroxide, diacetyl peroxydicarbonate, dicyclohexyl peroxydicarbonate, di-2-ethylhexyl peroxydicarbonate, tert-butyl perneodecanoate, 2,2,-azobis-(4-methoxy-2,4-dimethylvaleronitrile), tert-butyl perpivalate, tert-butyl per-2-ethylhexanoate, tert-butyl permaleate, 2,2'-azobisisobutyronitrile, bis-(tert-butylperoxy)-cyclohexane, tert-butyl peroxyisopropylcarbonate, tert-butyl peracetate, dicumyl peroxide, di-tert-amyl peroxide, di-tert-butyl peroxide, p-methane hydroperoxide, cumene hydroperoxide and tert-butyl hydroperoxide, and mixtures of these. These initiators are usually used in amounts from 0.1 to 10, preferably from 0.2 to 5, % by weight, based on the monomers.

The copolymerization is usually carried out at from 40° to 400° C., preferably from 80° to 300° C., and advantageously under superatmospheric pressure when (meth)-acrylates and vinyl esters or solvents having boiling points below the polymerization temperature are used. The polymerization is advantageously carried out in the absence of air, ie. when it is not possible to carry out the reaction at the boil, under an inert substance, for example nitrogen, since atmospheric oxygen slows down the polymerization. The reaction can be accelerated by the concomitant use of redox coinitiators, for example benzoin, dimethylaniline, ascorbic acid and complexes, which are soluble in organic solvents, of heavy metals such as copper, cobalt, manganese, iron, nickel and chromium. The amounts usually employed are from 0.1 to 2,000, preferably from 0.1 to 1,000, ppm by weight. In selecting the initiator or the initiator system, it is advantageous to ensure that the half life of the initiator or of the initiator system is less than 3 hours at the chosen polymerization temperature. At 150° C., for example, the half life of tert-butyl hydroperoxide is less than 3 hours. On the other hand, the initiator system comprising 1% by weight of tert-butyl hydroperoxide and 5 ppm by weight of copper(II) acetylacetonate displays, at as low as 100° C., polymerization behavior similar to that of 1% by weight of tert-butyl hydroperoxide at 150° C. If polymerization is begun, for example, at a lower temperature and is completed at a higher temperature, as a rule 2 or more initiators are used.

To obtain low molecular weight copolymers, it is often advantageous to carry out the reaction in the presence of regulators. Examples of suitable regulators are allyl alcohols, such as but-1-en-3-ol, organic mercapto compounds, such as 2-mercaptoethanol, 2-mercaptopropanol, mercaptoacetic acid, mercaptopropionic acid, tert-butyl mercaptan, n-butyl mercaptan, n-octyl mercaptan, n-dodecyl mercaptan and tert-dodecyl mercaptan, which are generally used in amounts of from 0.1 to 10% by weight.

The stated initiators, coinitiators, regulators and polymerization temperatures are just as suitable for all polymerization methods. Apparatuses which are suitable for the polymerization are, for example, conventional stirred kettles having, for example, an anchor, paddle or impeller stirrer or a multistage impulse counter-current agitator, and those suitable for the continuous preparation are stirred kettle cascades, tube reactors and static mixers.

The simplest polymerization method is mass polymerization. In this procedure, the (meth)acrylates and/or the vinyl esters and the monomers containing acid groups are polymerized in the presence of an initiator and in the absence of solvents. This process is particularly suitable for copolymers in which the (meth)acrylates and vinyl esters used possess 12 or more carbon atoms. Advantageously, all monomers are mixed in the desired composition and a small amount, eg. about 5–10%, is initially taken in the reactor and heated to the desired polymerization temperature while stirring, and the remaining monomer mixture and the initiator and any coinitiator and the regulator are metered in uniformly over from 1 to 10, preferably from 2 to 5, hours. It is advantageous to meter in the initiator and the coinitiator separately in the form of solutions in a small amount of a suitable solvent. The copolymer can then be converted into the novel fuel additive directly in the melt or after dilution with a suitable solvent.

A continuous high pressure process which permits space-time yields of from 1 to 50 kg of polymer per liter of reactor per hour is also suitable for the preparation of the desired copolymers. The polymerization apparatus used can be, for example, a pressure kettle, a pressure kettle cascade, a pressure tube or a pressure kettle having a downstream reactor tube which is provided with a static mixer. The monomers comprising (meth)acrylates, vinyl esters and monoethylenically unsaturated compounds containing acid groups are preferably polymerized in two or more polymerization zones connected in series. One reaction zone can consist of a pressure-tight kettle while the other consists of a heatable static mixer. This method gives conversions of more than 99%. A copolymer of stearyl acrylate and acrylic acid can be prepared, for example, by feeding the monomers and a suitable initiator continuously to a reactor or two reaction zones connected in series, for example a reactor cascade, and removing the reaction product continuously from the reaction zone after a residence time of from 2 to 60, preferably from 5 to 30, minutes at from 200° to 400° C. The polymerization is advantageously carried out under more than 1, preferably from 1 to 200, bar. The resulting copolymers having solids contents greater than 99% can then be further converted into the corresponding alkali metal salts and alkaline earth metal salts or amides and ammonium salts.

Another method for the simple preparation of the copolymers is precipitation polymerization. The solvents used in precipitation polymerization are those in which the monomers are soluble and the resulting copolymer is insoluble and is precipitated. Examples of such solvents are ethers, such as diethyl ether, dipropyl ether, dibutyl ether, methyl tert-butyl ether, diethylene glycol dimethyl ether and mixtures of these. Particularly when concentrations higher than 40% by weight are used, it is advantageous to carry out the precipitation polymerization in the presence of a protective colloid in order to prevent aggregation. Suitable protective colloids are polymeric substances which are readily soluble in the solvents and do not undergo any reaction with the monomers. Examples of suitable substances are copolymers of maleic anhydride with vinyl alkyl ethers and/or olefins of 8 to 20 carbon atoms and their monoesters with $C_{10}$–$C_{20}$–alcohols or mono- and diamides with $C_{10}$–$C_{20}$–alkylamines, as well as polyalkyl vinyl ethers whose alkyl group contains 1 to 20 carbon atoms, for example polymethyl, polyethyl, polyisobutyl and polyoctadecyl vinyl ether. The amounts of protective colloid added are usually from 0.05 to 4, preferably from 0.1 to 2, % by weight (based on monomers used), and it is often advantageous to combine several protective colloids. In the polymerization, it is advantageous initially to take the solvent, the protective colloid and some of the monomer mixture in the reactor and to meter in the remainder of the monomer mixture and the initiator and any coinitiator and regulator at the selected polymerization temperature with thorough stirring. The feed times for monomers and initiator are in general from 1 to 10, preferably from 2 to 5, hours. It is also possible to polymerize all starting materials together in a reactor, but problems with heat removal may arise, so that such a procedure is less advantageous. The concentrations of the monomers to be polymerized are from 20 to 80, preferably from 30 to 70, % by weight The polymers can be isolated from the polymer suspensions directly in evaporators, for example belt dryers, paddle dryers, spray dryers and fluidized bed dryers. When suitable solvents which can be added directly to fuels are employed, the further conversion to the alkali metal salt or alkaline earth metal salt and amide and/or ammonium salt can be carried out directly in the suspension.

The preferred embodiment of the preparation of the copolymers is solution polymerization. It is carried out in solvents in which the monomers and the resulting copolymers are soluble. Suitable solvents for this procedure are all those which meet this condition and which do not undergo any reactions with the monomers. Examples are acetone, methyl ethyl ketone, diethyl ketone, methyl isobutyl ketone, ethyl acetate, butyl acetate, aliphatic, cycloaliphatic and aromatic hydrocarbons, such as n-octane, isooctane, cyclohexane, methylcyclohexane, benzene, toluene, xylene, ethylbenzene, cumene, tetrahydrofuran and dioxane, xylene, ethylbenzene, cumene, tetrahydrofuran and dioxane being particularly suitable for obtaining low molecular weight copolymers. As in mass and precipitation polymerization, it is advantageous in this case too initially to take the solvent and some of the monomer mixture (eg. about 5-20%) and to meter in the remainder of the monomer mixture with the initiator and any coinitiator and regulator. It is also possible initially to take the solvent and (meth)-acrylate or vinyl ester in the polymerization reactor and then, after the polymerization temperature has been reached, to meter in the monomer containing acid groups, if necessary dissolved in the solvent, and the initiator and any coinitiator and regulator. The concentrations of the monomers to be polymerized are from 20 to 80, preferably from 30 to 70, % by weight. The solid copolymer can be readily isolated by evaporating the solvent. In this case too, however, it is advantageous to select a solvent in which it is possible to carry out the further conversion to the alkali metal salt or alkaline earth metal salt or the reaction with ammonia and/or amines.

The copolymers of (meth)acrylates and/or vinyl esters with monomers containing acid groups, which copolymers are obtained in the first process stage, are then completely or partially converted into the alkali metal salts or alkaline earth metal salts and, if they have been only partially converted into the said salts, are reacted with ammonia and/or amines to give the amides and/or ammonium salts. However, it is also possible to carry out the subsequent reaction of the copolymers in the reverse order by first reacting the copolymers with amines to give the corresponding amides and/or ammonium salts and then converting the products into the alkali metal salts or alkaline earth metal salts.

For converting the copolymers to the amides and/or ammonium salts, amines of not more than 50 carbon atoms are used.

As a rule, the amines used are of the general formula

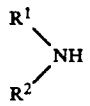

where $R^1$ and $R^2$ are identical or different unsubstituted or substituted hydrocarbon radicals which may be monoolefinically unsaturated and are generally of 1 to 25, preferably 5 to 25, carbon atoms, or $R^1$ is H—and $R^2$ is an unsubstituted or substituted hydrocarbon radical which may be monoolefinically unsaturated and is in general of 1 to 50, preferably 5 to 50, in particular 8 to 30, carbon atoms. Examples of suitable amines are di-2-ethylhexylamine and dioleylamine. Isotridecylamine and diisotridecylamine are particularly advantageously used.

In general, from 5 to 80%, preferably from 10 to 70%, in particular from 15 to 60%, of the acid groups of the copolymers are converted into the amides and/or ammonium salts. The reaction of the copolymers of (meth)-acrylates and/or vinyl esters and monomers containing acid groups with the amines is carried out in general in the melt or after dilution with a suitable solvent. Examples of suitable solvents are the solvents stated above for the preparation of the copolymers by precipitation and solution polymerization. Aromatic, aliphatic or cycloaliphatic hydrocarbons are preferably used.

In the reaction with the amines, in general temperatures of from 20° to 150° C., preferably from 20° to 120° C., in particular from 30° to 100° C., are used.

For example, specifically in the reaction with the amines, the copolymer is initially taken, eg. in a reaction vessel, for example in molten form or in a solvent, and the amine is introduced while stirring at from 60° to 90° C. and is reacted for from 1 to 2 hours with stirring. In the case of the copolymers which are derived from monoethylenically unsaturated dicarboxylic acids, this procedure generally gives the semiamide in which, when excess amine is added, the remaining carboxyl group is in the form of the alkylammonium salt.

The resulting amides and/or ammonium salts of the copolymers of (meth)acrylates and/or vinyl esters with monomers containing acid groups are reacted with a basic alkali metal compound or alkaline earth metal compound, for example the hydroxides, carbonates or alcoholates, in order to convert the remaining carboxyl groups into the alkali metal salts or alkaline earth metal salts. For example, in order to prepare the potassium salts, the solutions of the amides and/or ammonium salts of the copolymers are reacted with the calculated amount of potassium compound, for example a solution of KOH or $KOCH_3$, advantageously in an alcohol, for example a $C_1$–$C_6$-alcohol, such as methanol, ethanol, propanol or butanol. The solvents and water formed are advantageously stripped off under reduced pressure from the resulting reaction mixture.

The novel fuel additives are used in the form of alkaline earth metal salts or alkali metal salts, the latter being preferred. Examples of suitable alkaline earth metal salts are the magnesium or calcium salts. Suitable alkali metal salts are the lithium, sodium, potassium, rubidium and cesium salts, the potassium salts being preferably used. The alkali metal or alkaline earth metal component in the novel fuel additives is in general not less than 3, preferably from 3 to 25, in particular from 4 to 20, particularly advantageously from 4 to 15, % by weight, based on the fuel additive.

The novel fuel additives are added to the fuels for gasoline engines as a rule in amounts of from 10 to 2,000, preferably from 50 to 1,000, ppm by weight.

The novel fuels may also contain known phenolbased or amine-based antioxidants in addition to the alkali metal salts or alkaline earth metal salts. It is particularly advantageous if fuel additives for cleaning the intake system or keeping it clean are combined with phenolic antioxidants for increasing the shelf life of the fuels.

Residue oils from the oxo alcohol synthesis have proven to be good solvents or solubilizers for the stated components to be added to the fuel.

Oxo alcohol residues from the butanol, isobutanol, pentanol, hexanol, heptanol, octanol, nonanol, decanol, undecanol or dodecanol synthesis are preferably used. The use of oxo alcohol residues from the butanol synthesis is particularly advantageous. It is also possible to use other solvents or solvent mixtures which give a homogeneous mixture of the components in the weight ratios stated above. The action of the novel gasoline additives is not restricted just to motor gasolines. We have found that they can also be used in aviation gasolines, in particular in aviation gasolines for piston engines. Furthermore, the novel compounds are effective not only in carburetor-type engines but also in engines with fuel-injection systems.

The fuels provided with the novel additive may contain further, conventional additives, for example additives which improve the octane number or oxygencontaining components, eg. methanol, ethanol or methyl tert-butyl ether.

The Examples which follow illustrate the invention.

Examples 1 to 10 describe the preparation of the copolymers from (meth)acrylates and/or vinyl esters with monomers containing acid groups.

Parts are by weight. The molecular weights were determined by gel permeation chromatography, tetrahydrofuran being used as an eluant and polystyrene fractions having a narrow molecular weight distribution being used for calibration.

EXAMPLE 1

In a stirred glass flask equipped with a reflux condenser, 318.8 parts of an 80% strength by weight solution of a $C_{18}$-$C_{22}$-alkyl acrylate in toluene, 585 parts of o-xylene, 4.5 parts of but-1-en-3-ol and 15 parts of 2-mercaptoethanol are heated to the boil at about 135° C., and a solution of 45 parts of acrylic acid and 15 parts of o-xylene is metered in over 2 hours and a solution of 9 parts of di-tert-butyl peroxide in 81 parts of o-xylene is metered in over 3 hours. Refluxing is then continued for a further 2 hours. The solids content of the solution is 32.1%. The molecular weight of the copolymer is 7,600.

EXAMPLE 2

In a stirred glass flask equipped with a reflux condenser, 255 parts of dodecyl acrylate, 385 parts of o-xylene 4.5 parts of but-1-en-3-ol and 15 parts of 2-mercaptoethanol are heated at the boil, and a solution of 45 parts of acrylic acid and 15 parts of xylene is metered in over 2 hours and a solution of 9 parts of ditert-butyl peroxide in 81 parts of xylene is metered in over 3 hours. Refluxing is then continued for a further 2 hours. The solids content of the solution is 32.9%. The molecular weight of the copolymer is 2,600.

EXAMPLE 3

In a stirred flask equipped with a reflux condenser, 255 parts of an octadecyl acrylate, 585 parts of o-xylene, 4.5 parts of but-1-en-3-ol and 15 parts of 2-mercaptoethanol are heated at the boil, and a solution of 45 parts of acrylic acid and 15 parts of o-xylene is metered in over 2 hours and a solution of 9 parts of ditert-butyl peroxide and 81 parts of o-xylene is metered in over 3 hours. Refluxing is then continued for a further 2 hours. The solids content of the solution is 32.6%. The molecular weight of the copolymer is 2,700.

EXAMPLE 4

In a stirred flask equipped with a reflux condenser, 210 parts of an octadecyl acrylate, 585 parts of o-xylene, 4.5 parts of but-1-en-3-ol and 15 parts of mercaptoethanol are heated at the boil, and a solution of 90 parts of acrylic acid and 15 parts of o-xylene is metered in over 2 hours and a solution of 9 parts of ditert-butyl peroxide and 81 parts of o-xylene is metered in over 3 hours. Refluxing is then continued for a further 2 hours. The solids content of the solution is 32.7%. The molecular weight of the copolymer is 1,500.

EXAMPLE 5

The procedure described in Example 4 is followed, except that, instead of acrylic acid, 90 parts of methacrylic acid are used. The solids content of the solution is 32.5%. The molecular weight of the copolymer is 2,050.

EXAMPLE 6

In a stirred flask equipped with a reflux condenser, 281.25 parts of an 80% strength by weight solution of a $C_{18}$–$C_{22}$–alkyl methacrylate (methacrylate of a $C_{18}$–$C_{22}$-alcohol mixture (Alfol 1822) from Condea Chemie, Hamburg) in xylene, 525 parts of o-xylene, 4.5 parts of but-1-en-3-ol and 15 parts of 2-mercaptoethanol are heated at the boil, and a solution of 75 parts of acrylic acid and 15 parts of o-xylene is metered in over 2 hours and a solution of 9 parts of di-tert-butyl peroxide and 81 parts of o-xylene is metered in over 3 hours. Refluxing is then continued for a further 2 hours. The solids content of the solution is 32.8%. The molecular weight of the copolymer is 3,000.

EXAMPLE 7

In a stirred flask equipped with a reflux condenser, 300 parts of an 80% strength solution of a $C_{18}$–$C_{22}$-alkyl methacrylate in o-xylene, 525 parts of o-xylene, 4.5 parts of but-1-en-3-ol and 15 parts of 2-mercaptoethanol are heated at the boil, and a solution of 60 parts of methacrylic acid and 15 parts of o-xylene is metered in over 2 hours and a solution of 9 parts of ditert-butyl peroxide and 81 parts of o-xylene is metered in over 3 hours. Refluxing is then continued for a further 2 hours. The solids content of the solution is 32.4%. The molecular weight of the copolymer is 2,700.

EXAMPLE 8

In a stirred flask equipped with a reflux condenser, 210 parts of an octadecyl acrylate, 585 parts of o-xylene, 4.5 parts of but-1-en-3-ol and 15 parts of 2-mercaptoethanol are heated to the boil at about 136° C., and a solution, at 60° C., of 90 parts of maleic anhydride and 15 parts of o-xylene is metered in over 2 hours and a solution of 9 parts of di-tert-butyl peroxide and 81 parts of o-xylene is metered in over 3 hours. Refluxing is then continued for a further 2 hours. The solids content of the solution is 32.6%. The molecular weight of the copolymer is 1,700.

EXAMPLE 9

In a stirred flask, 270 parts of an octadecyl acrylate, 30 parts of maleic anhydride, 600 parts of o-xylene and 9 parts of but-1-en-3-ol are heated to the boil at about 140° C, and a solution of 9 parts of di-tertbutyl peroxide and 81 parts of o-xylene is metered in over 3 hours. Refluxing is then continued for a further 2 hours. The solids content of the solution is 34.1%. The molecular weight of the copolymer is 6,200.

EXAMPLE 10

In a stirred flask equipped with a reflux condenser, 210 parts of an octadecyl acrylate, 90 parts of vinylphosphonic acid and 600 parts of tetrahydrofuran are heated to the boil at about 70° C., and a solution of 12 parts of tert-butyl perpivalate, 70% strength by weight in an aliphatic solvent, and 100 parts of tetrahydrofuran is metered in over 2 hours. Refluxing is then continued for a further 2 hours. The solids content of the solution is 31.6%. The molecular weight of the copolymer is 3,600.

EXAMPLES 11 TO 19

The copolymers obtained in Examples 1 to 10 were converted into the novel fuel additives according to Examples 11 to 19 by first reacting them with ammonia or an amine to give the corresponding amides and/or ammonium salts and then converting the products into the corresponding potassium salts, or by converting them completely into the potassium salts.

For the preparation of the potassium salts, 20% strength by weight ethanolic KOH solution which contained the calculated amount of KOH was added to solutions of the copolymers or the amides and/or ammonium salts of the copolymers, and the solvent and the water formed were distilled off from the resulting mixture under reduced pressure at from 70° to 90° C.

The Table gives details of the reaction conditions for Examples 11 to 19. The number of moles is based on 100 g of copolymer.

TABLE

| Example | Copolymer of Example | Amount of comonomers in the copolymer [% by weight] | Mole of acid in 100 g of copolymer | Reaction/ 100 g of polymer with amine [mol] | Neutralization of the remaining carboxyl groups with KOH [mol] | Potassium content [% by weight, based on nove end |
|---|---|---|---|---|---|---|
| 11 | 1 | $C_{18}/C_{22}$-alkyl acrylate 85<br>Acrylic acid 15 | 0.208 | — | 0.208 | 7.52 |
| 12 | 2 | Dodecyl acrylate 85<br>Acrylic acid 15 | 0.208 | — | 0.208 | 7.52 |
| 13 | 3 | Octadexyl acrylate 85 | 0.208 | — | 0.208 | 7.52 |

TABLE-continued

| Example | Copolymer of Example | Amount of comonomers in the copolymer [% by weight] | Mole of acid in 100 g of copolymer | Reaction/ 100 g of polymer with amine [mol] | Neutralization of the remaining carboxyl groups with KOH [mol] | Potassium content [% by weight, based on nove end |
|---|---|---|---|---|---|---|
| 14 | 4 | Acrylic acid 15<br>Octadecyl acrylate 70 | 0.419 | 0.139<br>$(C_{13}H_{27})_2NH$ | 0.278 | 7.6 |
| 15 | 5 | Acrylic acid 30<br>Octadecyl acrylate 70 | 0.349 | — | 0.349 | 12.0 |
| 16 | 5 | Methacrylic acid 30<br>Octadecyl acrylate 70 | 0.349 | 0.066<br>$(C_{13}H_{27})_2NH$ | 0.283 | 8.16 |
| 17 | 5 | Methacrylic acid 30<br>Octadecyl acrylate 70 | 0.349 | 0.102 | 0.247 | 8.2 |
| 18 | 6 | Methacrylic acid 30<br>$C_{18}$/C22-alkyl methacrylate 75 | 0.347 | 0.068<br>$(C_{13}H_{27})_2NH$ | 0.279 | 8.05 |
| 19 | 7 | $C_{18}/C_{22}$-alkyl methacrylate 80 | 0.233 | — | 0.233 | 8.3 |

EXAMPLE 20

In order to demonstrate the advantageous effect of the novel fuels on the corrosion behavior of gasoline engines, unleaded, additive-free Super-Ottokraftstoff (SOK), premium grade gasoline engine fuel, product of the Mannheim oil refinery) is subjected to a corrosion test according to DIN 51,585 or ASTM D 665-60 or IP 135/64 at 23° C. for 24 h, the novel fuel additives of Examples 11 to 19 being added to the fuel, in each case in an amount of 10 ppm by weight, based on potassium. In the case of the novel fuels, no corrosion is found on the steel finger. On the other hand, corrosion level 3 is found in the case of the additive-free fuel.

EXAMPLE 21

In the engine test using an Opel Kadett engine according to CEC F-02-C-79 with a fuel according to Example 20, to which 10 ppm by weight, based on potassium, of the compound of Example 15 have been added, the valve deposits are reduced from, on average, 386 mg per intake valve to 237 mg per intake valve. This greatly reduces the usual additive requirement for protecting the intake systems and keeping them clean.

We claim:

1. A fuel for gasoline engines, containing small amounts of copolymers of alkyl (meth)acrylates where the alkyl radical is of 8 to 40 carbon atoms and/or vinyl esters of carboxylic acids of 8 to 40 carbon atoms and monoethylenically unsaturated mono- and/or dicarboxylic acids of 3 to 12 carbon atoms, having a total molecular weight of from 500 to 20,000 g per mole, some or all of the carboxyl groups of the copolymers having been reacted with an alkali with formation of the alkali metal salts and the remainder of the carboxyl groups having been reacted with ammonia and/or amines of not more than 50 carbon atoms to give the corresponding amide groups and/or ammonium salts, with the proviso that the fuel contains from 10 to 2,000 ppm by weight of the alkali metal salts

2. A fuel as defined in claim 1, wherein the copolymers contain not less than 3% by weight of the alkali.

3. A fuel as defined in claim 1, wherein the carboxyl groups of the copolymers have been reacted with formation of the potassium salts.

* * * * *